United States Patent [19]

Dickakian

[11] 4,086,156

[45] Apr. 25, 1978

[54] PITCH BONDED CARBON ELECTRODE

[75] Inventor: Ghazi Mourad Dickakian, Brussels, Belgium

[73] Assignee: Exxon Research & Engineering Co., Linden, N.J.

[21] Appl. No.: 788,404

[22] Filed: Apr. 18, 1977

Related U.S. Application Data

[63] Continuation-in-part of Ser. No. 637,223, Dec. 3, 1975, abandoned.

[30] Foreign Application Priority Data

Dec. 13, 1974 United Kingdom ..... 53926/74

[51] Int. Cl.[2] ..... C25C 7/02; C10C 3/00; C10C 3/06

[52] U.S. Cl. ..... 204/294; 208/41; 208/44

[58] Field of Search ..... 208/41, 44; 204/294

[56] References Cited

U.S. PATENT DOCUMENTS

| | | | |
|---|---|---|---|
| 2,848,424 | 8/1958 | Stanko | 252/502 |
| 3,238,116 | 3/1966 | Hamner et al. | 208/6 |
| 3,324,029 | 6/1967 | King et al. | 208/97 |
| 3,725,240 | 4/1973 | Baum | 208/76 |
| 3,970,542 | 7/1976 | Bongertman | 208/22 |
| 4,017,378 | 4/1977 | Fauveau et al. | 208/41 |

*Primary Examiner*—F.C. Edmundson
*Attorney, Agent, or Firm*—Rebecca Yablonsky

[57] ABSTRACT

This invention relates to the production of chemical pitch by stripping under reduced pressure steam cracker tar to obtain a pitch having an initial boiling point of between 350° C and 400° C at atmospheric pressure, heat soaking the pitch at 360° to 420° C in the absence of air or oxygen at sub-atmospheric to 4 atmospheres absolute and stripping under reduced pressure the soaked pitch to obtain a product having a minimum softening point (R and B) of 75° C. This pitch can be mixed with coke to make electrodes especially suitable for aluminium production.

13 Claims, No Drawings

PITCH BONDED CARBON ELECTRODE

This application is a continuation-in-part of my application, Ser. No. 637,223 filed on Dec. 3, 1975, now abandoned.

This invention relates to chemical pitch, especially suitable for making carbon electrodes useful for aluminium production and other electrochemical industries.

Various processes have been proposed for making petroleum and coal tar pitch suitable for making electrodes. The binder material used in the preparation of carbon electrodes should be thermally stable and of uniform consistency and quality. The binder material should be sufficiently fluid at the temperatures at which it is mixed with coke completely to wet and penetrate the coke. The binder material should be highly aromatic and should also have a high coking value of at least 45 wt.% (SMTTP Method No: PT-10-67) and good electrical properties.

Hamner et al in their U.S. Pat. No. 3,238,116 teach the oxidative polymerization of petroleum tar to make a binder pitch. Likewise Baum in his U.S. Pat. No. 3,725,240 teaches a continuous blowing operation of a bottoms fraction from a fractionated vis-broken cycle stock to produce a binder pitch. In such processes air or oxygen is essential to effect the polymerization since when the pitch is produced some of the pitch molecules are linked by oxygen-carbon bonds. This type of structure is however very undesirable for binders used for electrodes because when the electrodes are baked during their manufacture they rupture (the C-O bond being weak) and result in foaming and cracking. Small particles of the cracked and/or spongy electrode fall into the electrolyte bath with disastrous results. Also such electrodes have a high electrical resistivity requiring high electrical current and additionally the carbon burns in the electrolytic cell as it is too reactive. Finally it can be pointed out that an oxidative polymerization process necessitates careful control of the air or oxygen stream to prevent a dangerous explosive situation being established. In fact these oxidative polymerization processes are not now recommended because of the safety hazards.

We have now discovered a method of making chemical pitch which is relatively cheap and which results in a product having good properties as a binder for making carbon electrodes for aluminium production. This pitch is chemically and physically different from coal tar pitch but can be used satisfactorily for electrode manufacture.

According to this invention, chemical pitch is prepared by a process which comprises stripping under reduced pressure steam cracker tar to obtain a pitch having an initial boiling point of between 350° and 400° C at atmospheric pressure, heat soaking the pitch at 360° to 420° C in the absence of air or oxygen at a pressure in the range of from sub-atmospheric to 4 atmospheres absolute, stripping under reduced pressure the soaked pitch to obtain a product having a minimum softening point (R and B) of 75° C. The process can be carried out continuously or as a batch process.

In my process the pitch is made by the cracking of tar molecules at the heat soaking stage where free radicals are produced. These radicals lead to the polymerization of tar into a poly condensed aromatic pitch without any oxygen linkages between molecules. Any oxygen which has been found after heat soaking is on the surface caused by oxidation when pouring the molten pitch from the reactor. Hence the electrodes made from pitch made by the process of this invention are not porous and do not crumble and avoid the difficulties caused with electrodes made from pitch obtained by oxidative polymerization methods.

The steam cracker tar which is used as the starting material is defined as the bottoms product obtained when steam cracking gas oil, naphtha or mixtures of such petroleum hydrocarbons at a temperature of from about 700° C to 1000° C. Typical processes are the steam cracking of gas oil or naphtha preferably at a temperature of 800° C to 900° C with a 50 to 70% conversion to $C_3$ olefin and lighter hydrocarbons during relatively short times of the order of seconds followed by stripping at a temperature of about 200° C to 250° C to obtain the tar as a bottoms product. Gas oil is to be understood as the liquid petroleum distillate with a viscosity and boiling range between kerosene and lubricating oil, and having a boiling range of about 200° C to 400° C. Examples of gas oil are vacuum gas oil, light gas oil and heavy gas oil. Naphtha is a generic term for refined, partly refined or unrefined petroleum products and liquid products of natural gas not less than 10% of which distil below 175° C, and not less than 95% of which distil below 240° C when subjected to distillation according to the standard method referred to as ASTM-D-86.

The characteristics of steam cracker tar vary according to the feed to the steam cracking plant. Thus the properties of the tars obtained when cracking vacuum gas oil and light gas oil are given below.

| | Vacuum Gas Oil | Light Gas Oil |
|---|---|---|
| Specific gravity at 20° C. | 1.15 | 1.10 |
| Asphaltene (n-heptane insolubles) wt.% | 20–25 | 10–15 |
| Viscosity (cps) at 210° F | 100 | 30 |
| Aromatic carbon atom % (by NMR method) | 71 | 71 |

Typical physical, elemental and chemical characteristics of steam cracker tars are as follows:

| | |
|---|---|
| Physical Analysis | |
| Sp. gr. at 20° C | 1.10–1.15 |
| Toluene insolubles - wt.% | 0.020–0.200 |
| Ash content - wt.% | 0.010–0.004 |
| Viscosity (cps) at 210° F | 20–200 |
| Conradson Carbon (wt.%) | 15–25 |
| Solvent Analysis | |
| n-heptane insolubles (wt.%) | 10–25 |
| Coking value of n-heptane insolubles wt.% | 50–65 |
| Chemical Analysis (NMR) | |
| Aromatic carbon atom % | 70–72 |
| Aliphatic/aromatic proton ratio | 1.3–1.6 |
| Elemental Analysis | |
| Carbon wt.% | 87.7–89.9 |
| Hydrogen wt.% | 6.67–7.37 |
| Oxygen wt.% | 0.10–0.20 |
| Sulphur wt.% | 1.0–5.0 |
| Nitrogen wt.% | 0.05–0.10 |
| C/H atomic ratio | 1.09–1.01 |
| Number Average mol.wt. | 250–310 |

The process of this invention comprises three steps namely:

(1) Stripping under reduced pressure to separate low boiling point fractions.

(2) Heat-soaking (thermal treatment) to increase the molecular weight and aromaticity of the pitch.

(3) Stripping under reduced pressure to adjust the softening point to at least 75° C, e.g. 100° to 135° C, preferably 110° to 120° C.

In the first step the steam cracker tar is stripped e.g. by vacuum stripping or steam stripping. Vacuum stripping is preferred because of the short time required.

The temperatures of tar depends on the pressure used during the stripping and a suitable temperature is between 200° C and 400° C at 10 to 100 mm Hg.

In this step of the process the low boiling fraction is removed so that the steam cracker tar can be heated to the high temperature required for heat-soaking. As a result of stripping, preferably vacuum stripping, pitch is obtained having an initial boiling point of 350° to 400° C at atmospheric pressure. This pitch could have a softening point of between 60° and 95° C (Ring and Ball method).

In the next step of the process of this invention the pitch obtained from stripping of the steam cracker tar is subjected to heat soaking at a temperature of from 360° C to 420° C in the absence of air or oxygen and at a reduced pressure or a pressure not exceeding 4 atmospheres absolute.

The heat soaking may be carried out for example in an autoclave or in a tubular soaking coil which may be of some considerable length, e.g. about 150 meters. The pitch, whilst it is subjected to heat soaking, must be maintained at a temperature of from 360° C to 420° C and at a pressure not exceeding 4 atmospheres absolute. Preferably the temperature is 370° C to 410° C, especially 380° C–390° C and the pressure is about atmospheric. The residence time for the heating soaking can vary, but is usually from 5 minutes to 6 hours, e.g. 5 minutes to 3 hours, preferably about 1 hour. The heat soaking is carried out in an inert atmosphere, e.g. under a blanket of nitrogen or steam.

In the heat soaking step the pitch is heated at high temperature without any substantial loss of material merely by distillation. During the heat soaking at 360° to 420° C paraffinic-rich molecules are separated from the pitch by the cleavage of carbon-carbon bonds. These paraffinic molecules because of their low molecular weight are removed from the heat soaked pitch. By heat soaking the aromaticity of the pitch is increased so that the pitch can be used satisfactorily for high temperature applications such as electrode manufacture.

The pitch which results from the heat soaking step has a low softening point, e.g. 60° to 90° C (R and B). In order to increase the softening point the soaked pitch is stripped under reduced pressure. This stripping may be flash stripping, e.g. using vacuum or steam stripping. Thus, if the soaked pitch is flash stripped it may be passed to an atmospheric flash distillation column or tower. Low boiling fractions are removed as distillate products, and the desired pitch product is discharged as bottoms product.

The product obtained after stripping, i.e. the desired pitch, has a softening point (R and B) of at least 75° C, e.g. 100° C to 135° C, preferably 100° C – 130° C. It is highly aromatic having a C:H atomic ratio of 1.35 to 1.50 and usually an aromatic carbon atom content of 73–80%. It usually has a coking value of 50 to 58% and benzene insolubles (wt.%) of 15–32. High C:H atomic ratio and high benzene insolubles are the required characteristics for good quality petroleum pitch when using steam cracker tar as a feedstock.

The properties of the pitch prepared by the process of this invention usually have the following properties:

| | General | Typical |
|---|---|---|
| Softening point ° C (R and B) | 100–120 | 110 |
| Coking value (SMTTP Method No: PT-10-67) | 48–58 | 53 |
| Benzene insoluble (wt.%) | 15–32 | 27 |
| Quinoline insoluble (wt. %) | 0.1–3 | 1.5 |
| Viscosity (cps) at 160° C | 2000–10000 | 5000–6000 |
| Ash content wt.% | 0.1–0.2 | 0.1 |
| Aromatic carbon atom % (NMR method) | 72–80 | 76 |
| Carbon/Hydrogen aromatic ratio | 1.35–1.50 | 1.40 |
| Accumulative wt.% loss at 1000° C (in nitrogen)* | 60–80 | 70 |
| Atmospheric Distillation (vol. % at 270° C) | Nil | Nil |
| vol.% at 360° C) | 3–10 | 5 |

*using thermogravimetric balance in inert medium e.g. pure nitrogen.

As far as volatility characteristics measured by thermogravimetric balance in inert medium are concerned the chemical pitch made by the process of this invention matches very closely the volatility characteristic of coal tar pitch.

The chemical pitch made by the process of this invention is excellent as a binder for carbon electrodes. To make electrodes, especially for aluminum production, the binder can be mixed with coke, usually in a proportion 14 to 17 wt.% based on the weight of coke for a prebaked electrode and 26 to 32 wt.% based on the weight of coke for the Soderberg type electrode. The mixing usually occurs at a temperature of 150° C to 170° C. The prebaked electrodes formed after extrusion or pressing are baked at high temperature using special ovens.

The properties of electrodes made with the pitch obtained by the process of this invention vary considerably and are dependent on coke and aggregate used, coke particle size distribution and heating rate during baking of green electrodes.

The chemical pitch made by the process of this invention may also be used as a binder for graphite electrodes, as a binder for manufacturing fibre boards and as a binder for foundry applications.

EXAMPLE 1

Into a laboratory reactor of 3.0 liters capacity equipped with an electrical heating system agitator and temperature recorder 2.0 kg. of steam cracker tar obtained from steam cracking vacuum gas oil was introduced. The tar was subjected to a vacuum of about 2:0 mm Hg and the tar was heated and stripped under reduced pressure. The tar fractions with a boiling point 180° to 370° C/atmospheric pressure was removed to give a distilled pitch with 75° C (R and B method) softening point.

The distilled pitch was then heated at atmospheric pressure to 390° C under a blanket of $N_2$ and the temperature of the pitch was maintained at 390° C for 30 minutes and the soft pitch (softening point 60° C R and B) while hot was subjected to reduced pressure to strip the low-boiling point fraction, leaving a product having a softening point of 110° C (R and B). The pitch was then cooled under vacuum to 200° C and poured out.

EXAMPLES 2, 3 and 4

The procedure of Example 1 was repeated in three further runs and the chemical pitch obtained had the following properties:

| | 2 | 3 | 4 |
|---|---|---|---|
| Heat time (hours) | 2 | 2 | 0.5 |
| Heat Soaking Temp. ° C | 375 | 390 | 390 |
| Softening Point ° C (R and B method) | 108 | 109 | 111 |
| Coking value wt.% | 50.4 | 51.5 | 50.8 |
| Quinoline insoluble wt.% | 0.5 | 1.0 | 0.5 |
| Benzene insoluble wt.% | 20.8 | 21.8 | 19.8 |
| Aromatic carbon atom % | 71.8 | 75.3 | 74.0 |
| Aliphatic aromatic proton ratio | 1.30 | 1.06 | 1.10 |
| Flash point ° C (COC method) | 240 | 240 | 240 |
| C/H atomic ratio | 1.4 | 1.4 | 1.4 |
| Accumulative wt.% loss at 1000° C (1) | 91.5 | 78 | 78 |
| Viscosity (cps at 160° C) | — | 2000 | 1500 |

(1) Where a sample is heated in a thermal-balance in the presence of pure nitrogen from 20° C to 1000° C the accumulative weight loss is calculated.

EXAMPLE 5

A prebaked electrode was prepared using pitch prepared by the process of Example 1. Crushed calcined coke was heated and mixed with molten pitch at 150°–170° C until a uniform paste was obtained. The hot paste was cooled with air and pressed in a special press at a temperature of between 100° and 110° C. After cooling with a water shower to harden a green electrode was obtained. The green electrode was baked in the absence of oxygen in a special oven where heating was increased gradually to approximately 100° C. Afterwards it was cooled gradually to ambient temperature whence a very satisfactory electrode was obtained.

EXAMPLES 6, 7, 8 and 9

Into a commercial reactor of 30 tons capacity equipped with direct firing at the bottom of the reactor, 20 tons of steam cracker tar obtained from steam cracking vacuum gas oil was introduced. The tar was subjected to a vacuum of about 150 mm Hg and the tar was heated and stripped under reduced pressure. The tar fractions with a boiling point 180° to 370° C/atmospheric pressure was removed to give a distilled pitch with approximately 75° C (R and B method) softening point.

The distilled pitch was then heated at atmospheric pressure to 385° C in an atmosphere of saturated hydrocarbon and the temperature of the pitch was maintained at 390° C for varying times and the soft pitch (softening point 60° C R and B) while hot was subjected to reduced pressure to strip the low boiling point fraction, leaving a product having a softening point of 110°–120° C. The pitch was then cooled under vacuum to 200° C and poured out.

The above procedure was carried out in four runs and the chemical pitch in each Example obtained had the following properties:

| Example No: | 6 | 7 | 8 | 9 |
|---|---|---|---|---|
| Heating Time (hours) | 3 | 4 | 6 | 3 |
| Heat Soaking Temp. (° C) | 385 | 385 | 385 | 385 |
| Softening Point (° C) | 112 | 113 | 115 | 119 |
| Coking Value (wt.%) | 53 | 52 | 53 | 55 |
| Quinoline Insolubles (wt.%) | 0.5 | 0.4 | 0.3 | 0.6 |
| Benzene Insolubles (wt.%) | 20.0 | 19.4 | 22 | 26.7 |
| Aromatic Carbon (atom %) | 76 | — | 76 | 78 |
| Aliphatic:Aromatic proton ratio | 1.20 | — | — | — |

-continued

| Example No: | 6 | 7 | 8 | 9 |
|---|---|---|---|---|
| Flash Point (° C) (COC) | 245 | 240 | 240 | 245 |
| C/H Aromatic Ratio | 1.37 | 1.35 | 1.37 | 1.47 |
| Viscosity (cps at 160° C) | 3500 | 3894 | 5477 | 8880 |

What is claimed is:

1. A process for preparing chemical pitch which comprises stripping under reduced pressure steam cracker tar to obtain a pitch having an initial boiling point of between 350° C and 400° C at atmospheric pressure, heat soaking the pitch at 360° C to 420° C in the absence of air or oxygen at a pressure in the range of from sub-atmospheric to 4 atmospheres absolute and stripping under reduced pressure the soaked pitch to obtain a product having a minimum softening point (R and B) of 75° C.

2. A process according to claim 1 wherein the steam cracker tar has the following characteristics:

| | |
|---|---|
| Sp. gr. at 20° C | 1.10 - 1.15 |
| Toluene insolubles (wt.%) | 0.020–0.200 |
| Ash content (wt.%) | 0.010–0.004 |
| Viscosity (cps) at 210° F | 20 - 200 |
| n-heptane insoluble | 10 - 25 |
| Coking value of n-heptane insoluble wt.% | 50 - 65 |
| Aromatic carbon atom % | 71 - 72 |
| Aliphatic/aromatic proton ratio | 1.3 - 1.6 |
| Number average molecular weight | 250 - 310 |
| Sulphur content (wt.%) | 1.0 - 5.0 |

3. A process according to claim 1 wherein the steam cracker tar is stripped by vacuum stripping.

4. A process according to claim 1 wherein the steam cracker is stripped at a temperature between 200° C and 400° C at a pressure of 10 to 100 mm Hg.

5. A process according to claim 1 wherein the pitch obtained after stripping the steam cracker tar has a softening point of between 60° and 95° C (R and B).

6. A process according to claim 5 wherein the pitch is heat soaked at a temperature of 380° C to 390° C and at about atmospheric pressure.

7. A process according to claim 1 wherein the pitch obtained from the heat soaking step has a softening point of 60° to 90° C (R and B).

8. A process according to claim 7 wherein the final product obtained after stripping has a softening point (R and B) of 100° C to 130° C.

9. A process according to claim 7 wherein the final product obtained after stripping has an aromatic carbon content of 73% to 80% and a coking value of 50% to 58%.

10. A process according to claim 7 wherein the final product obtained after stripping has a C:H atomic ratio of 1.35 to 1.50 and a benzene insolubles (wt.%) of 15 to 32.

11. Chemical pitch whenever prepared by a process claimed in claim 1.

12. An electrode comprising coke and 14 to 17 wt.% based on the weight of coke of chemical pitch as claimed in claim 11.

13. An electrode comprising coke and 26 to 32 wt.% based on the weight of coke of chemical pitch as claimed in claim 11.

* * * * *